US006160393A

United States Patent [19]

Ahn et al.

[11] Patent Number: 6,160,393

[45] Date of Patent: Dec. 12, 2000

[54] LOW POWER VOLTAGE REFERENCE CIRCUIT

[75] Inventors: Sung-tae Ahn, Kwacheon; Yong-jin Jeon, Anyang, both of Rep. of Korea

[73] Assignee: Samsung Electronics Co., Ltd., Kyungki-do, Rep. of Korea

[21] Appl. No.: 09/418,333

[22] Filed: Oct. 14, 1999

[30] Foreign Application Priority Data

Jan. 29, 1999 [KR] Rep. of Korea ..... 99-2949

[51] Int. Cl.[7] ..... G05F 3/16

[52] U.S. Cl. ..... 323/315

[58] Field of Search ..... 323/313, 314, 323/315, 317; 330/257, 288; 327/535, 538, 539

[56] References Cited

U.S. PATENT DOCUMENTS 5,164,658 11/1992 Kuwahara ..... 323/315
5,180,966 1/1993 Sugawara et al. ..... 323/315
5,670,868 9/1997 Moriguchi et al. ..... 323/313
5,677,621 10/1997 Bult et al. ..... 323/315
5,914,868 6/1999 Han et al. ..... 363/60
5,949,278 9/1999 Oguey ..... 327/543

*Primary Examiner*—Matthew Nguyen
*Attorney, Agent, or Firm*—F. Chau & Associates, LLP

[57] ABSTRACT

A bandgap voltage reference circuit according to the present invention generates a constant reference voltage and is not affected by variations in a power supply voltage and in a manufacturing process. In the bandgap voltage reference circuit, a constant voltage supply unit supplies a constant voltage, a first current mirror mirrors a first current flowing through the constant voltage supply unit to generate a second current, and a second current mirror controlled by the constant voltage from the constant voltage supply unit mirrors the second current to generate a third current and outputs the third current to an output node. A voltage reference unit is connected to the output node to provide a reference voltage to the output node. The voltage reference unit includes at least one PMOS transistor and at least one NMOS transistor which are connected to each other in series or in parallel. Ion implantation processes for determining threshold voltages of the PMOS transistor and the NMOS transistor are simultaneously performed.

21 Claims, 4 Drawing Sheets

LOW POWER VOLTAGE REFERENCE CIRCUIT

BACKGROUND OF THE INVENTION

1. Field of the Invention

The present invention relates to a semiconductor integrated circuit, and more particularly, to a bandgap voltage reference circuit for providing a constant reference voltage in a semiconductor integrated circuit.

2. Description of the Related Art

Bandgap voltage reference circuits are used in semiconductor integrated circuits to generate a constant reference voltage. In a semiconductor integrated circuit using a bandgap voltage reference circuit, the accuracy of operation of the semiconductor integrated circuit depends on the ability of the bandgap voltage reference circuit to provide a constant reference voltage. Thus, the bandgap voltage reference circuit is required to stably generate a constant reference voltage. There are several factors which can cause fluctuations of a reference voltage output from the bandgap voltage reference circuit. For example, variations in temperature is a common factor.

The above information is widely known to those skilled in the art, and a conventional CMOS bandgap voltage reference circuit providing a constant reference voltage without being affected by temperature variation has been disclosed in "CMOS Analog Circuit Design" by Allen/Holberg, at pages 596–599. Another conventional CMOS bandgap voltage reference circuit has been disclosed in U.S. Pat. No. 4,588,941 patented to D. A. KERTH on May 13, 1986.

However, in conventional bandgap voltage reference circuits, a reference voltage can fluctuate with variations in a power supply voltage and in a manufacturing process of semiconductor integrated circuits.

SUMMARY OF THE INVENTION

To solve the above and other problems, it is an object of the present invention to provide a bandgap voltage reference circuit which generates a constant reference voltage and is not affected by variations in a power supply voltage and in a manufacturing process of semiconductor integrated circuits.

Accordingly, to achieve the above as well as other objects, there is provided a bandgap voltage reference circuit comprising: a constant voltage supply unit for generating a constant voltage; a first current mirror for mirroring a first current flowing through the constant voltage supply unit to generate a second current; and a second current mirror controlled by the constant voltage from the constant voltage supply unit, for mirroring the second current to generate a third current. The bandgap voltage reference circuit according to the present invention further comprises a voltage reference unit receiving the third current from the second current mirror, for generating a reference voltage to an output node. The voltage reference unit includes at least one PMOS transistor and at least one NMOS transistor. Ion implantation processes for determining threshold voltages of the PMOS transistor and the NMOS transistor are simultaneously performed.

The bandgap voltage reference circuit according to the present invention can further comprise a resistor connected between the output node and the voltage reference unit.

According to a preferred embodiment of a bandgap voltage reference circuit of the present invention, a voltage reference unit includes at least one PMOS transistor and at least one NMOS transistor which are connected to each other in series or in parallel between an output node and a ground voltage. A constant voltage supply unit comprises: a PMOS transistor having a source connected to a power supply voltage; and a resistor having one end connected to a drain of the PMOS transistor and the other end connected to a gate of the PMOS transistor, wherein a constant voltage is output from a drain of the PMOS transistor. A first current mirror comprises: a first NMOS transistor having a drain connected to the constant voltage supply unit and a source connected to the ground voltage; and a second NMOS transistor having a drain and a gate connected in common to a gate of the first NMOS transistor and to a second current mirror, and a source connected to the ground voltage. The second current mirror comprises: a first PMOS transistor having a source connected to the power supply voltage, a drain connected to the first current mirror, and a gate connected to the constant voltage supply unit; and a second PMOS transistor having a source connected to the power supply voltage, a drain connected to the output node, and a gate connected to the constant voltage supply unit.

According to another embodiment of the present invention, a voltage reference unit includes at least one PMOS transistor and at least one NMOS transistor which are connected to each other in series or in parallel between a power supply voltage and an output node. A constant voltage supply unit comprises: an NMOS transistor having a source connected to a ground voltage; and a resistor having one end connected to a drain of the NMOS transistor and the other end connected to a gate of the NMOS transistor, wherein a constant voltage is output from a drain of the NMOS transistor. A first current mirror comprises: a first PMOS transistor having a drain connected to the constant voltage supply unit and a source connected to a power supply voltage; and a second PMOS transistor having a drain and a gate connected in common to a gate of the first PMOS transistor and to a second current mirror, and a source connected to the power supply voltage. The second current mirror comprises: a first NMOS transistor having a source connected to a power supply voltage, a drain connected to the first current mirror, and a gate connected to the constant voltage supply unit; and a second NMOS transistor having a source connected to the power supply voltage, a drain connected to the output node, and a gate connected to the constant voltage supply unit.

BRIEF DESCRIPTION OF THE DRAWINGS

The above objects and advantages of the present invention will become more apparent by describing in detail preferred embodiments thereof with reference to the attached drawings in which.

DESCRIPTION OF PREFERRED EMBODIMENTS

Figure 1:
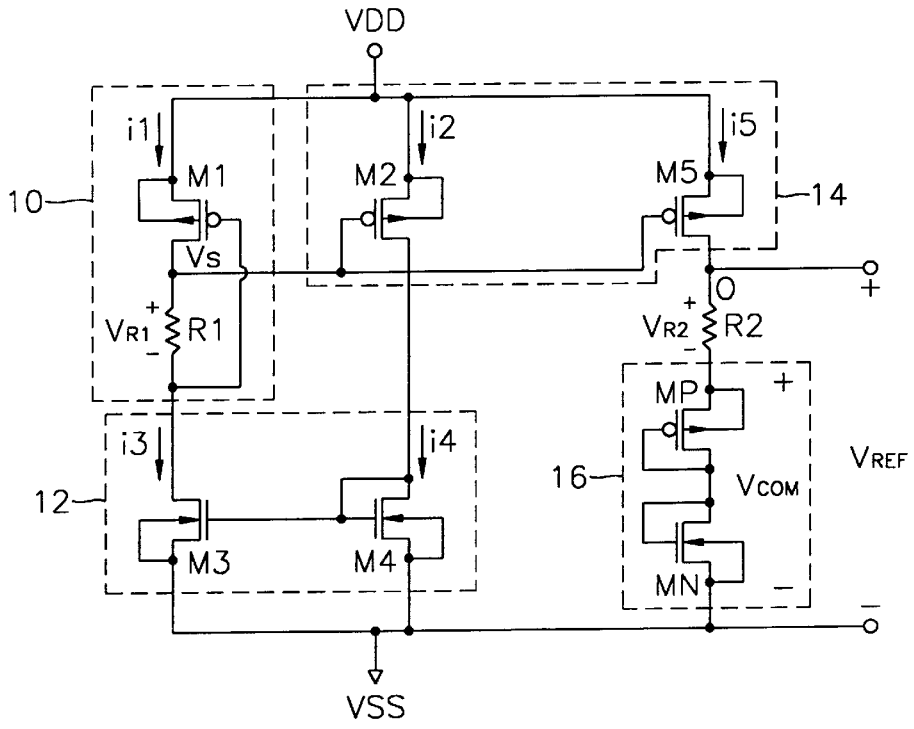
FIG. 1 is a circuit diagram of a bandgap voltage reference circuit according to a first embodiment of the present invention.

Hereinafter, preferred embodiments of the present invention will be described in detail with reference to the attached drawings. However, the embodiments of the present invention can be modified into various other forms, and the scope of the present invention must not be interpreted as being restricted to the embodiments. The embodiments are provided to more completely explain the present invention to those skilled in the art. Like reference numerals in the drawings denote the same members.

Referring to FIG. 1, a bandgap voltage reference circuit according to a first embodiment includes a constant-voltage supply unit 10, a first current mirror 12, a second current mirror 14, and a voltage reference unit 16.

The constant-voltage supply unit 10 includes a PMOS transistor M1 having a source connected to a power supply voltage VDD, and a resistor R1 having one end connected to a drain of the PMOS transistor M1 and the other end connected to a gate of the PMOS transistor M1. Current i1 flows through the PMOS transistor M1 and the resistor R1. A constant voltage Vs is output from a drain of the PMOS transistor M1. Thus, the constant voltage Vs is kept constant in spite of variations in the power supply voltage VDD.

The first current mirror 12 including NMOS transistors M3 and M4 mirrors a current i3 to generate a current i4. The currents i3 and i4 flow the NMOS transistors M3 and M4, respectively. The current i3 is a current flowing through the constant voltage supply unit 10. In other words, the first current mirror 12 mirrors the current flowing through the constant voltage supply unit 10 to the current i4. A drain of the NMOS transistor M3 is connected to the other end of the resistor R1, and a source thereof is connected to a ground voltage VSS. A drain and a gate of the NMOS transistor M4 are connected in common to the second current mirror 14 and a gate of the NMOS transistor M3, and a source thereof is connected to the ground voltage VSS.

The second current mirror 14 includes PMOS transistors M2 and M5 which are controlled by the constant voltage Vs, and mirrors a current i2 flowing through the PMOS transistor M2 to generate a current i5 flowing through the PMOS transistor M5. The current i2 is a current applied to the NMOS transistor M4 of the first current mirror 12 to flow therethrough. In other words, the second current mirror 14 mirrors the current flowing through the NMOS transistor M4 of the first current mirror 12 to the current i5 which is output through an output node O. A source of the PMOS transistor M2 is connected to the power supply voltage VDD, a gate thereof is connected to the constant voltage Vs, and a drain thereof is connected to the drain of the NMOS transistor M4 of the first current mirror 12. A source of the PMOS transistor M5 is connected to the power supply voltage VDD, a gate thereof is connected to the constant voltage Vs, and a drain thereof is connected to the output node O through which a reference voltage $V_{REF}$ is output.

The voltage reference unit 16 is connected between the output node O and the ground voltage VSS to provide the reference voltage $V_{REF}$ to the output node O. The voltage reference unit 16 includes at least one PMOS transistor MP and at least one NMOS transistor MN which are connected to each other in series between the output node O and the ground voltage VSS. A source of the PMOS transistor MP is connected to the output node O. A drain and a gate of the NMOS transistor MN are connected in common to a drain and a gate of the PMOS transistor MP. A source of the NMOS transistor MN is connected to the ground voltage VSS.

However, threshold voltages of the PMOS transistor MP and the NMOS transistor MN in the voltage reference unit 16 can fluctuate due to variations in a manufacturing process, so that a voltage $V_{COM}$ between both ends of the voltage reference unit 16 can also fluctuate. In order to prevent the voltage $V_{COM}$ between the ends of the voltage reference unit 16 from fluctuating due to variations in a manufacturing process, ion implantation processes for determining the threshold voltages of the PMOS transistor MP and the NMOS transistor MN in the voltage reference unit 16 are performed simultaneously during the manufacturing process.

The bandgap voltage reference circuit according to the first embodiment of the present invention may further include a resistor R2 connected between the output node O and the voltage reference unit 16.

It will now be described why the reference voltage $V_{REF}$, an output of the bandgap voltage reference circuit according to the first embodiment of the present invention, is not affected by variations in the power supply voltage VDD.

First, when the PMOS transistors M1, M2 and M5 and the NMOS transistors M3 and M4 operate in a weak inversion region, and a channel length modulation effect of these transistors is ignored, current formula of each of the transistors M1 through M5 can be expressed by the following equations.

The current formula of the PMOS transistor M1 is expressed by the following Equation 1:

$$i1=\mathbf{S1}.ip.\exp\{q.\ |\mathrm{Vgs}\mathbf{1}|/(np.k.T)\} \quad (1)$$

The current formula of the PMOS transistor M2 is expressed by the following Equation 2:

$$i2=\mathbf{S2}.ip.\exp\{q.\ |\mathrm{Vgs}\mathbf{2}|/(np.k.T)\} \quad (2)$$

The current formula of the NMOS transistor M3 is expressed by the following Equation 3:

$$i3=\mathbf{S3}.ip.\exp\{q.\ |\mathrm{Vgs}\mathbf{3}|/(np.k.T)\} \quad (3)$$

The current formula of the NMOS transistor M4 is expressed by the following Equation 4:

$$i4=\mathbf{S4}.ip.\exp\{q.\ |\mathrm{Vgs}\mathbf{4}|/(np.k.T)\} \quad (4)$$

The current formula of the PMOS transistor M5 is expressed by the following Equation 5:

$$i5=\mathbf{S5}.ip.\exp\{q.\ |\mathrm{Vgs}\mathbf{5}|/(np.k.T)\} \quad (5)$$

In Equations 1 through 5, S1 through S5 denote width-to-length ratios of the transistors M1 through M5, respectively, ip denotes a parameter corresponding to a manufacturing process for the PMOS transistors, in denotes a parameter corresponding to a manufacturing process for the NMOS transistors, Vgs1 through Vgs5 denote voltages between the gates and sources of the transistors M1 through M5 respectively, np denotes a subthreshold slope factor of the PMOS transistors, nn denotes a subthreshold slope factor of the NMOS transistors, q denotes electric charge, k denotes the Boltzmann's constant, and T denotes a temperature.

A voltage $V_{R1}$ between both ends of the resistor R1 is expressed by the following Equation 6:

$$V_{R1}=|\mathrm{Vg}S1-\mathrm{Vgs}2| \tag{6}$$

When Vgs1 and Vgs2 are calculated from Equations 1 and 2 and substituted into Equation 6, $V_{R1}$ is expressed by the following Equation 7:

$$V_{R1}=(np.k.T/q).\ \ln\{(S2/i2).(i1/S1)\} \tag{7}$$

Since the currents i1 and i3 are the same, the currents i2 and i4 are the same, and the NMOS transistors M3 and M4 form a current mirror, i.e., Vgs3 is equal to Vgs4, the following Equation 8 is formed:

$$(i1/i2)=(i3/i4)=(S3/S4) \tag{8}$$

When Equation 8 is substituted into Equation 7, $V_{R1}$ is expressed by the following Equation 9:

$$V_{R1}=(np.k.T/q).\ \ln\{(S2/S4).(S3/S1\ )\} \tag{9}$$

When Equation 9 is substituted into i1=$V_{R1}$/R1, i1 is expressed by the following Equation 10:

$$i1=(np.k.T/q/R1).\ \mathrm{In}\{(S2/S4).(S3/S1)\} \tag{10}$$

When Equation 10 is substituted into the Equation i2=(S4/S3).i1 obtained from Equation 8, i2 is expressed by the following Equation 11:

$$i2=(S4/S3).(np.k.T/q/R1).\ \ln\{(S2/S4).(S3/S1)\} \tag{11}$$

Since the PMOS transistors M2 and M5 form a current mirror, i.e., Vgs2 is equal to Vgs5, Equations 2 and 5 form the following Equation 12:

$$i5=(S5/S2).i2 \tag{12}$$

When Equation 11 is substituted into Equation 12, i5 is expressed by the following Equation 13:

$$i5=(S4/S3).(S5/S2).(np.k.T/q/R1).\ \ln\{(S2/S4).(S3/S1)\} \tag{13}$$

Referring to Equation 13, i5 includes no parameters associated with the power supply voltage VDD, and thus has a constant value without being affected by variations in the power supply voltage VDD when the width-to-length ratios of the transistors M1 through M5, S1 through S5, are determined.

The reference voltage $V_{REF}$ is expressed by the following Equation 14:

$$V_{REF}=i5.R2+V_{COM} \tag{14}$$

Since i5 has a constant value and is not affected by variations in the power supply voltage VDD as described above, assuming $V_{COM}$ is constant $V_{COM}$ can vary with variations in the manufacturing process. It will be described in detail in the latter portion of the description), $V_{REF}$ is also kept constant without being affected by variations in the power supply voltage VDD.

When the channel length modulation effect of the PMOS transistors M1, M2 and M5 and the NMOS transistors M3 and M4 is considered, the relationship between the current i5 and the power supply voltage VDD is described as follows.

When the power supply voltage VDD increases, the current i1 increases with an increase in a voltage Vds3 between the drain and the source of the NMOS transistor M3. When the current i1 increases, a voltage |Vgs1| between the source and the gate of the PMOS transistor M1 and the voltage $V_{R1}$ between the ends of the resistor R1 are increased. Since Vgs1 is a logarithmic function of i1 and $V_{R1}$ is a linear function of i1, the increment of $V_{R1}$ becomes larger than the increment of |Vgs|. Thus, the voltage |Vgs2| between the source and the gate of the PMOS transistor M2, and the voltage |Vgs5| between the source and the gate of the PMOS transistor M5 are decreased.

Meanwhile, when the power supply voltage VDD is increased, a voltage Vds5 between the source and the drain of the PMOS transistor M5 is increased. Thus, the channel length modulation effect can be generated. However, when the power supply voltage VDD is increased, the voltage |Vgs5| is simultaneously reduced as described above. Thus, the influence of the channel length modulation effect is compensated for, so that the current i5 is affected little by variations in a power supply voltage. That is, the current i5 is kept constant without being affected by variations in the power supply voltage VDD, so that the reference voltage $V_{REF}$ is kept constant without being affected by variations in the power supply voltage VDD.

It will now be described how the output of the bandgap voltage reference circuit according to the first embodiment of the present invention, i.e., the reference voltage $V_{REF}$, is not affected by variations in the manufacturing process.

When the PMOS transistor MP and the NMOS transistor MN in the voltage reference unit 16 operate in a saturation region, current formulas of the transistors MP and MN can be expressed as follows.

The current formula of the PMOS transistor MP is expressed by the following Equation 15:

$$i5=\beta p/2.(Vdsp-|Vtp|)^2 \tag{15}$$

wherein βp denotes a transconductance parameter of the PMOS transistor MP, Vdsp denotes a voltage between the drain and the source of the PMOS transistor MP, and Vtp denotes a threshold voltage of the PMOS transistor MP.

The current formula of the NMOS transistor MN is expressed by the following Equation 16:

$$i5=\beta n/2.(Vdsn-Vtn)^2 \tag{16}$$

wherein βn denotes a transconductance parameter of the NMOS transistor MN, Vdsn denotes a voltage between the drain and the source of the NMOS transistor MN, and Vtn denotes a threshold voltage of the NMOS transistor MN.

The voltage $V_{COM}$ between the ends of the voltage reference unit 16 is expressed by the following Equation 17:

$$V_{COM}=Vdsp+Vdsn \tag{17}$$

When Vdsp and Vdsn are obtained from Equations 15 and 16 and substituted into Equation 17, $V_{COM}$ is expressed by the following Equation 18:

$$V_{COM}=|Vtp|+\sqrt{2.i5/\beta p}+\mathrm{Vtn}+\sqrt{2.i5/\beta n} \tag{18}$$

wherein Vtn, Vtp, βp, and $\beta_n$ can fluctuate with variations in the manufacturing process. In particular, Vtn and Vtp have the greatest influence on the fluctuation in $V_{COM}$. Therefore, in the bandgap voltage reference circuit according to the first embodiment of the present invention, ion implantation processes for determining the threshold voltages of the PMOS transistor MP and the NMOS transistor MN are simultaneously performed in the manufacturing process to reduce the fluctuation in the sum Vtn+Vtp of the threshold voltages of the PMOS transistor MP and the NMOS transistor MN, as described above.

Figure 5:
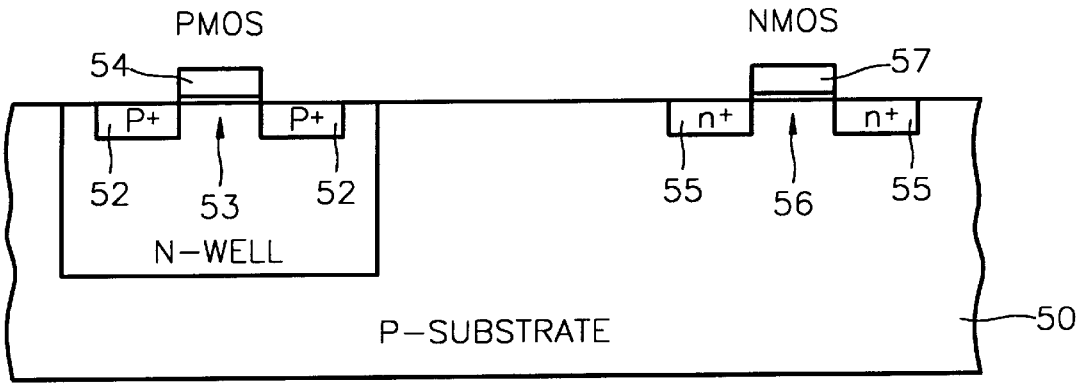
FIG. 5 is a vertical cross-sectional view of a MOS transistor to explain impurity ion implantations.

Referring to FIG. 5 illustrating a vertical cross-sectional view of a MOS transistor, it will now be described in more detail how the reference voltage $V_{REF}$ is maintained at a constant value.

Threshold voltages of MOS transistors are determined by several parameters of a manufacturing process, but the biggest factor affecting variations in the threshold voltages is impurity ion implantation concentrations for gate channels 53 and 56 of the MOS transistors. In a general CMOS manufacturing process, impurity ion implantation for the gate channel 56 of an NMOS transistor, and impurity ion implantation for the gate channel 53 of a PMOS transistor are independently performed to control the values of Vtn and Vtp. In this case, a correlation between Vtn and Vtp is not accomplished.

On the other hand, when ion implantation processes for determining the threshold voltages of the NMOS transistor and the PMOS transistor, i.e., the impurity ion implantation processes for the gate channel 56 of the NMOS transistor and for the gate channel 53 of the PMOS transistor, are simultaneously performed, a correlation between Vtn and Vtp is formed according to variations in the impurity ion implantation concentration.

Figure 6:
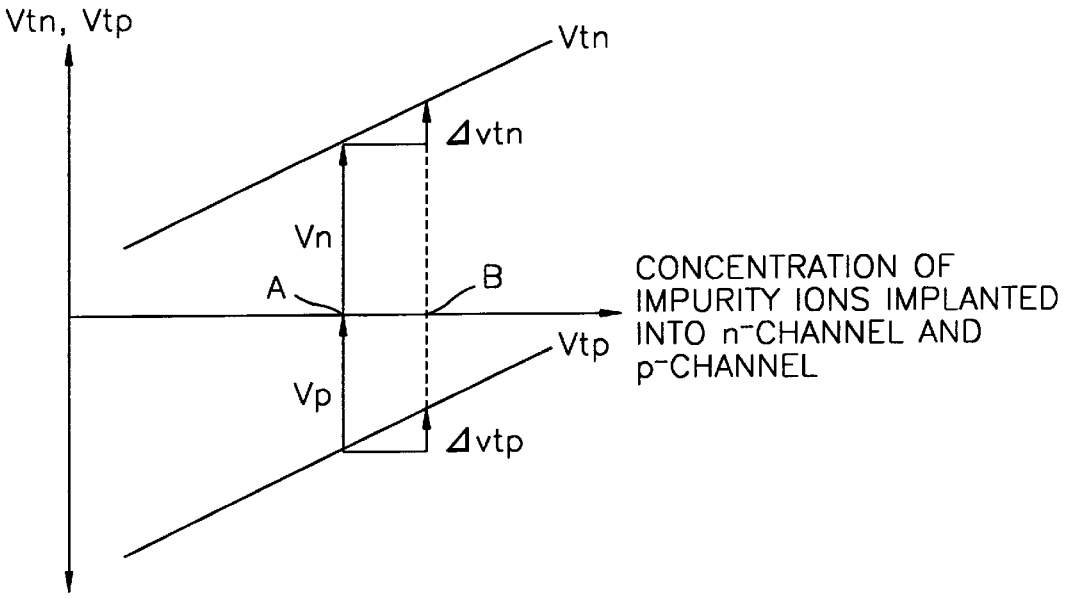
FIG. 6 is a graph showing variations in a threshold voltage of a PMOS transistor and a threshold voltage of an NMOS transistor according to variations in an impurity ion concentration.

For example, when impurity ions such as boron are simultaneously implanted into the gate channel 56 of the NMOS transistor and the gate channel 53 of the PMOS transistor in FIG. 5, an acceptor concentration of the gate channel 56 of the NMOS transistor increases, and a dornor concentration of the gate channel 53 of the PMOS transistor decreases. Thus, the threshold voltage Vtn of the NMOS transistor increases, and the threshold voltage Vtp of the PMOS transistor decreases, as shown in FIG. 6. When a threshold voltage is changed from a target point A to a target point B due to a variation in the ion implantation concentration, the threshold voltage of the NMOS transistor is increased from Vn to Vn+ΔVtn, and the threshold voltage of the PMOS transistor is increased from Vp to Vp−ΔVtp. Thus, the sum of the threshold voltages of the PMOS transistor and the NMOS transistor maintains a substantially constant value. Accordingly, $V_{COM}$ also maintains a constant value. Therefore, $V_{REF}$ maintains a constant value without being affected by variations in the manufacturing process.

Figure 2:
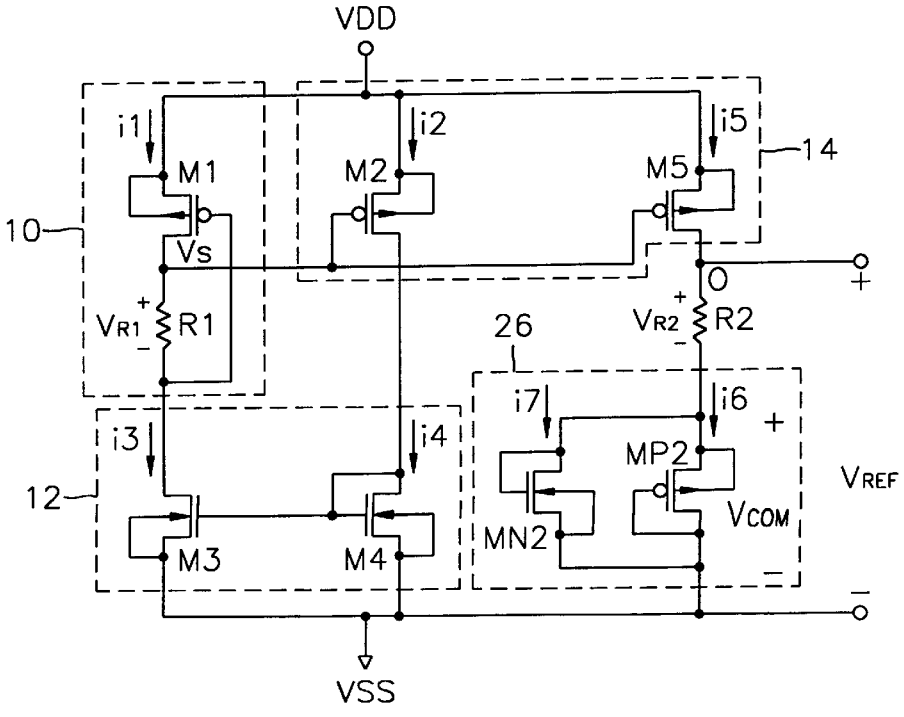
FIG. 2 is a circuit diagram of a bandgap voltage reference circuit according to a second embodiment of the present invention.

FIG. 2 is a circuit diagram of a bandgap voltage reference circuit according to a second embodiment of the present invention.

Referring to FIG. 2, the bandgap voltage reference circuit according to the second embodiment has the same configuration as that according to the first embodiment, except for a voltage reference unit 26.

The voltage reference unit 26 is connected between the output node O through which the reference voltage $V_{REF}$ is output and the ground voltage VSS. The voltage reference unit 26 includes at least one PMOS transistor MP2 and at least one NMOS transistor MN2 connected to each other in parallel between the output node O and the ground voltage VSS.

A source of the PMOS transistor MP2 is connected to the output node O, and a gate and a drain thereof are connected in common to the ground voltage VSS. A gate and a drain of the NMOS transistor MN2 are connected in common to the output node O, and a source thereof is connected to the ground voltage VSS.

In the bandgap voltage reference circuit according to the second embodiment of the present invention, ion implantation processes for determining threshold voltages of the PMOS transistor MP2 and the NMOS transistor MN2 in the voltage reference unit 26 are, as in the first embodiment, simultaneously performed in a manufacturing process to prevent a voltage $V_{COM}$ between both ends of the voltage reference unit 26 from fluctuating with variations in the manufacturing process.

Here, the reference voltage $V_{REF}$, i.e., an output of the bandgap voltage reference circuit according to the second embodiment, is maintained at a constant value without being affected by variations in the power supply voltage VDD according to the same principle as in the first embodiment. The principle described in the first embodiment is omitted here.

It will now be described how the reference voltage $V_{REF}$ of the bandgap voltage reference circuit according to the second embodiment of the present invention is not affected by variations in the manufacturing process.

When the PMOS transistor MP2 and the NMOS transistor MN2 in the voltage reference unit 26 operate in a saturation region, current formulas of the transistors MP2 and MN2 can be expressed as follows.

The current formula of the PMOS transistor MP2 is expressed by the following Equation 19:

$$i6=\beta p/2.(V_{COM}-|Vtp|)^2 \tag{19}$$

wherein βp denotes a transconductance parameter of the PMOS transistor MP2, $V_{COM}$ denotes a voltage between the drain and the source of the PMOS transistor MP2, and Vtp denotes a threshold voltage of the PMOS transistor MP2.

The current formula of the NMOS transistor MN2 is expressed by the following Equation 20:

$$i7=\beta n/2.(V_{COM}-Vtn)^2 \tag{20}$$

wherein βn denotes a transconductance parameter of the NMOS transistor MN2, $V_{COM}$ denotes a voltage between the drain and the source of the NMOS transistor MN2, and Vtn denotes a threshold voltage of the NMOS transistor MN2.

The current i5 of the PMOS transistor M5 is expressed by the following Equation 21:

$$i5=i6+i7 \tag{21}$$

When Equations 29 and 20 are substituted into Equation 21, i5 is expressed by the following Equation 22:

$$i5=\beta p/2(V_{COM-|Vtp|})^2+\beta n/2.(V_{COM-Vtn})^2 \tag{22}$$

$V_{COM}$ is obtained from Equation 22 and can be expressed by the following Equation 23:

$$V_{COM}=(\beta n\cdot Vtn+\beta p\cdot|Vtp|)/(\beta n+\beta p)+\sqrt{2\cdot i5/(\beta n+\beta p)-\beta n\cdot\beta p\cdot(Vtn-|Vtp|)^2/(\beta n+\beta p)^2} \tag{23}$$

When the threshold voltage Vtn of the NMOS transistor MN2 is expressed as Vn+ΔVtn, the threshold voltage |Vt| of the PMOS transistor MP2 is expressed as Vp−ΔVtp, and ΔVtp/ΔVtn is equal to n, $V_{COM}$ can be expressed by the following Equation 24:

$$\{(\beta n \cdot Vn + \beta p \cdot Vp|)/(\beta n + \beta p) + (\beta n + \beta p) + (\beta n - n \cdot \beta p)/(\beta n + \beta p) \cdot \sqrt{2 \cdot i5/(\beta n + \beta p) - \beta n \cdot \beta p \cdot (Vn - Vp + \Delta Vtn + n \cdot \Delta Vtn)^2/(\beta n + \beta p)^2} \quad (24)$$

wherein Vn denotes a target value for the threshold voltage Vtn of the NMOS transistor MN2, ΔVtn denotes the amount of variation of the threshold voltage Vtn according to a variation in an impurity ion concentration of impurities implanted into a gate channel of the NMOS transistor MN2, Vp denotes a target value for the threshold voltage Vtp of the PMOS transistor MP2, and ΔVtp denotes the amount of variation of the threshold voltage Vtp according to a variation in an impurity ion concentration of impurities implanted into a gate channel of the PMOS transistor MP2. When the values of a gate width and a gate length of the NMOS transistor MN2 and those of the PMOS transistor MP2 are determined so that βn/βp can be equal to n, $V_{COM}$ can be expressed by the following Equation 25:

$$\begin{aligned} V_{COM} &= (\beta n.Vn + \beta p.Vp|)/(\beta n + \beta p) + \sqrt{2.i5/(\beta n + \beta p) - \beta n.\beta p.(Vn - Vp + \Delta Vtn + n.\Delta Vtn)^2/(\beta n + \beta p)^2} \\ &= (n.Vn + Vp)/(1 + n) + \sqrt{2.i5/\beta p/(n + 1) - n.(\Delta Vtn - [Vp - Vn]/[1 + n])^2} \end{aligned} \quad (25)$$

Figure 7:
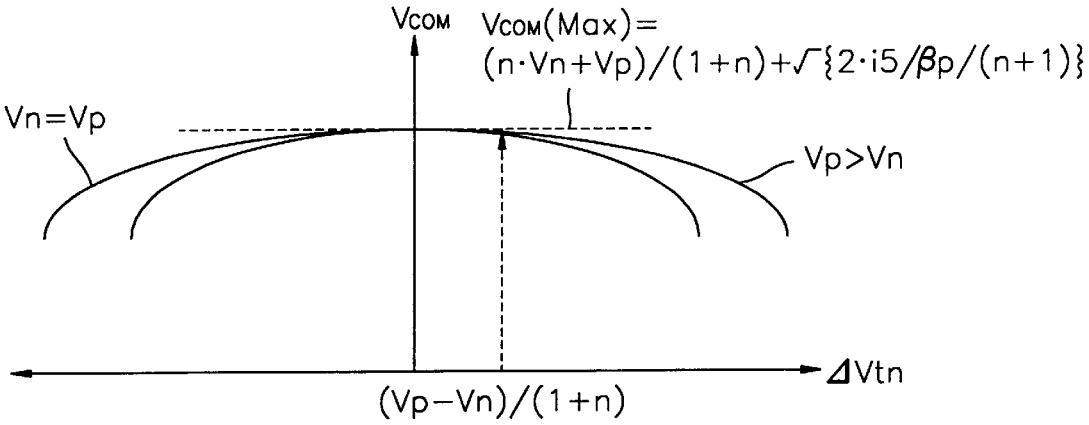
FIG. 7 is a graph showing characteristics of a voltage $V_{COM}$ between the ends of a voltage reference unit with respect to an increase ΔVtn in a threshold voltage of an NMOS transistor according to a difference between a threshold voltage of a PMOS transistor and a threshold voltage of an NMOS transistor.

FIG. 7 is a characteristics graph of $V_{COM}$ with respect to ΔVtn according to the difference between Vp and Vn. When ΔVtn is equal to (Vp−Vn)/(1+n), $V_{COM}$ has a maximum value. When the impurity ion concentration is determined so that Vp and Vn can become the same, $V_{COM}$ is expressed by the following Equation 26:

$$V_{COM} = Vn + \sqrt{2.i5/\beta p/(n+1) - n.(\Delta Vtn)^2} \quad (26)$$

Figure 8:
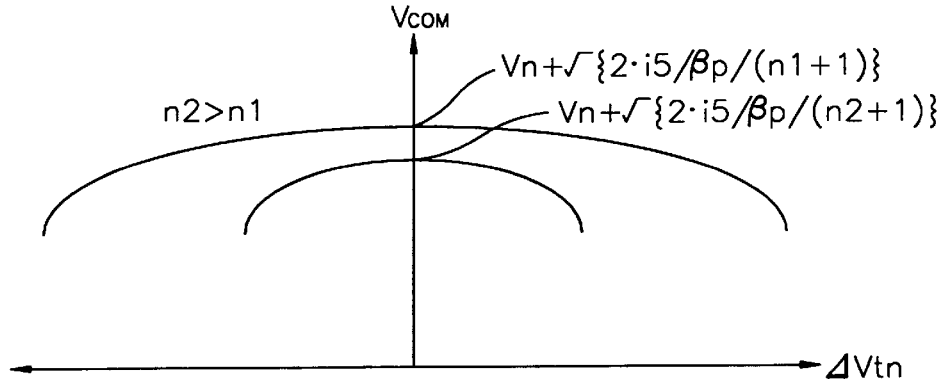
FIG. 8 is a graph showing characteristics of a voltage $V_{COM}$ between the ends of a voltage reference unit with respect to an increase ΔVtn in a threshold voltage of an NMOS transistor according to a ratio (n) of an increase ΔVtp in a threshold voltage of a PMOS transistor to the increase ΔVtn in a threshold voltage of an NMOS transistor.

FIG. 8 is a characteristics graph of $V_{COM}$ with respect to ΔVtn according to a ratio (n) of ΔVtp to ΔVtn.

Consequently, in the bandgap voltage reference circuit according to the second embodiment, the gate width and gate length of the NMOS transistor MN2 and those of the PMOS transistor MP2 are determined so that βn/βp becomes n when ΔVtp/ΔVtn is equal to n, and the impurity ion concentration is determined so that the threshold of the NMOS transistor MN2 can become the same as that of the PMOS transistor MP2. In this way, the dependency of $V_{COM}$ on variations in the threshold voltage is improved. Therefore, the reference voltage $V_{REF}$ is substantially not affected by variations in the manufacturing process.

Figure 3:
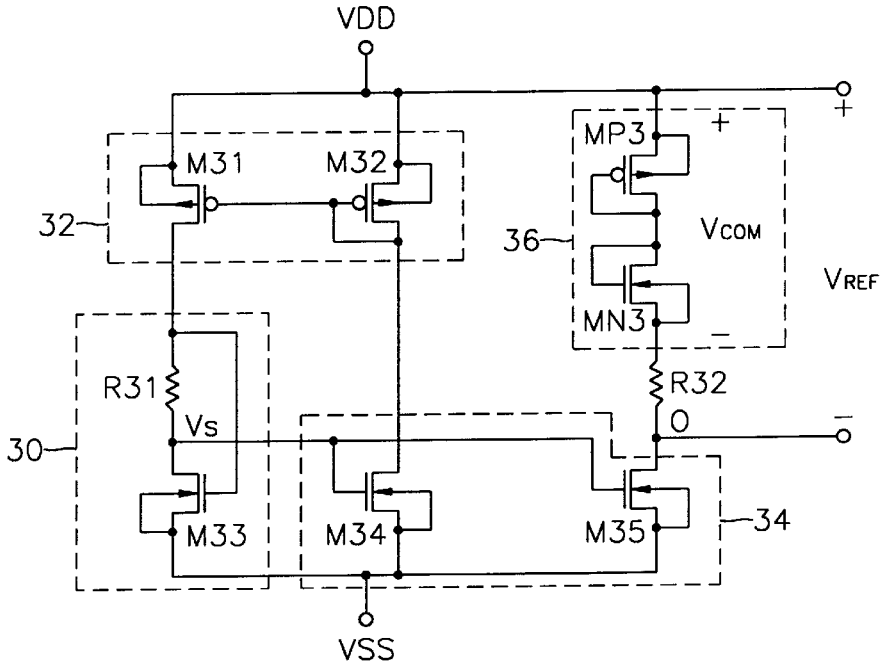
FIG. 3 is a circuit diagram of a bandgap voltage reference circuit according to a third embodiment of the present invention.

FIG. 3 is a circuit diagram of a bandgap voltage reference circuit according to a third embodiment of the present invention.

Referring to FIG. 3, the bandgap voltage reference circuit according to the third embodiment includes a constant voltage supply unit 30, a first and a second current mirrors 32 and 34, and a voltage reference unit 36 as in the first embodiment. Comparing the bandgap voltage reference circuit according to the third embodiment with that of the first embodiment, the PMOS transistors in the first embodiment are replaced with NMOS transistors, the NMOS transistors in the first embodiment are replaced with PMOS transistors, the power supply voltage VDD of the first embodiment is replaced with a ground voltage VSS, and the ground voltage VSS of the first embodiment is replaced with a power supply voltage VDD.

The constant voltage supply unit 30 includes an NMOS transistor M33 having a source connected to the ground voltage VSS, and a resistor R31 having one end connected to a drain of the NMOS transistor M33 and the other end connected to a gate of the NMOS transistor M33. A constant voltage Vs is output from the drain of the NMOS transistor M33. Thus, the constant voltage Vs is kept constant in spite of variations in the power supply voltage VDD.

The first current mirror 32 includes PMOS transistors M31 and M32, and mirrors a current flowing through the constant voltage supply unit 30, i.e., a current flowing through the PMOS transistor M31, to a current flowing through the PMOS transistor M32. In other words, the first current mirror 32 mirrors the current flowing through the PMOS transistor M31 to generate the current flowing through the PMOS transistor M32. A drain of the PMOS transistor M31 is connected to the other end of the resistor R31, and a source thereof is connected to the power supply voltage VDD. A drain and a gate of the PMOS transistor M32 are connected in common to a gate of the PMOS transistor M31 and to the second current mirror 34, and a source thereof is connected to the power supply voltage VDD.

The second current mirror 34 includes NMOS transistors M34 and M35 which are controlled by the constant voltage Vs, and provides a mirroring operation to a current flowing through the PMOS transistor M32 of the first current mirror 32, i.e., a current flowing through the NMOS transistor M34, to a current flowing through the NMOS transistor M35. In other words, the second current mirror 34 mirrors the current flowing through the NMOS transistor M34 to generate the current flowing through the NMOS transistor M35 and output the generated current to an output node O. A source of the NMOS transistor M34 is connected to the ground voltage VSS, a gate thereof is connected to the constant voltage Vs, and a drain thereof is connected to the drain of the PMOS transistor M32 in the first current mirror 32. A source of the NMOS transistor M35 is connected to the ground voltage VSS, a gate thereof is connected to the constant voltage Vs, and a drain thereof is connected to the output node O through which a reference voltage $V_{REF}$ is output.

The voltage reference unit 36 is connected between the output node O and the power supply voltage VDD to provide the reference voltage $V_{REF}$ to the output node O. The voltage reference unit 36 includes at least one PMOS transistor MP3 and at least one NMOS transistor MN3 connected to each other in series between the output node O and the power supply voltage VDD. A source of the NMOS transistor MN3 is connected to the output node O, a drain and a gate thereof are commonly connected to those of the PMOS transistor MP3, and a source of the PMOS transistor MP3 is connected to the power supply voltage VDD.

Similar to the first embodiment, in the third embodiment, ion implantation processes for determining threshold voltages of the PMOS transistor MP3 and the NMOS transistor MN3 in the voltage reference unit 36 are simultaneously performed in the manufacturing process to prevent the voltage $V_{COM}$ between the ends of the voltage reference unit 36 from fluctuating with variations in the manufacturing process. The bandgap voltage reference circuit according to the third embodiment of the present invention can further include a resistor R32 connected between the output node O and the voltage reference unit 36.

According to the same principle as described in the first embodiment, the output of the bandgap voltage reference circuit according to the third embodiment, i.e., the reference voltage $V_{REF}$, is maintained at a constant value without being affected by variations in the power supply voltage VDD and in the manufacturing process. Since described in detail in the first embodiment, the principle is omitted.

Figure 4:
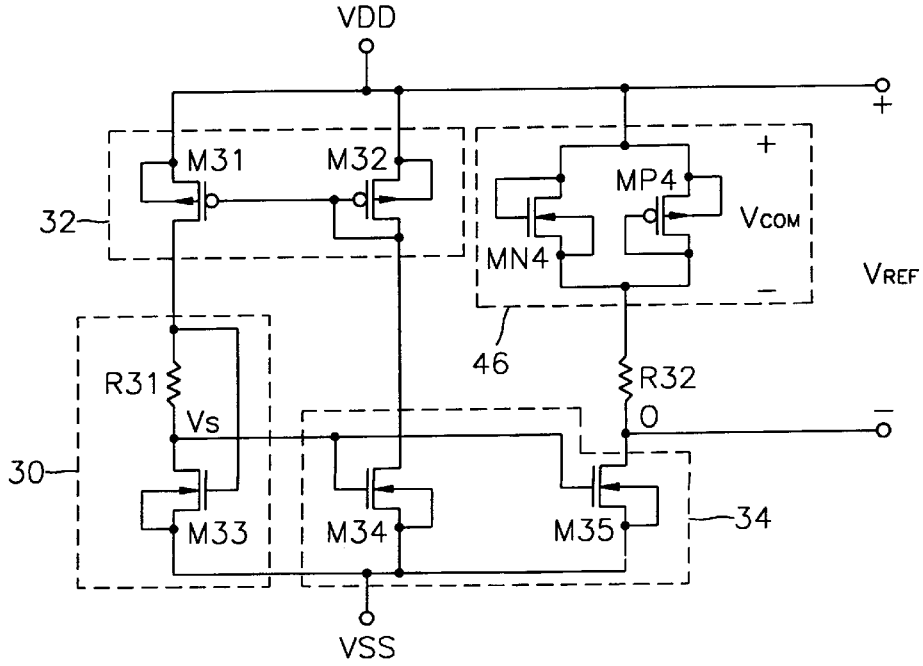
FIG. 4 is a circuit diagram of a bandgap voltage reference circuit according to a fourth embodiment of the present invention.

FIG. 4 is a circuit diagram of a bandgap voltage reference circuit according to a fourth embodiment of the present invention.

Referring to FIG. 4, the bandgap voltage reference circuit according to the fourth embodiment has the same configuration as the third embodiment except for a voltage reference unit 46.

The voltage reference unit 46 is connected between the power supply voltage VDD and the output node O through which the reference voltage $V_{REF}$ is output. The voltage reference unit 46 includes at least one PMOS transistor MP4 and at least one NMOS transistor MN4 connected to each other in parallel between the output node O and the power supply voltage VDD.

A source of the PMOS transistor MP4 is connected to the power supply voltage VDD, and a gate and a drain thereof are connected in common to the power supply voltage VDD. A gate and a drain of the NMOS transistor MN4 are commonly connected to the power supply voltage VDD, and a source thereof is connected to the output node O.

Similar to the first embodiment, in the bandgap voltage reference circuit according to the fourth embodiment, ion implantation processes for determining threshold voltages of the PMOS transistor MP4 and the NMOS transistor MN4 in the voltage reference unit 46 are simultaneously performed in the manufacturing process to prevent the voltage $V_{COM}$ between both ends of the voltage reference unit 46 from fluctuating with variations in the manufacturing process.

According to the same principle as described in the first embodiment, the output of the bandgap voltage reference circuit according to the fourth embodiment, i.e., the reference voltage $V_{REF}$, is maintained at a constant value without being affected by variations in the power supply voltage VDD and in the manufacturing process.

As described above, a bandgap voltage reference circuit according to the present invention generates a constant reference voltage without being affected by variations in a power supply voltage and/or in a manufacturing process.

Having described preferred embodiments of the present invention, it is noted that modifications and variations can be made by persons skilled in the art in light of the above teachings. It is therefore to be understood that changes may be made in the particular embodiments of the invention disclosed which are within the scope and spirit of the invention as outlined by the appended claims.

What is claimed is:

1. A voltage reference circuit comprising:

a constant voltage supply unit for generating a constant voltage;

a first current mirror for mirroring a first current flowing through the constant voltage supply unit to generate a second current;

a second current mirror controlled by the constant voltage from the constant voltage supply unit, for mirroring the second current to generate a third current;

a voltage reference unit for providing a reference voltage in response to the third current, said voltage reference unit includes a PMOS transistor and a NMOS transistor, wherein ion implantation processes for determining threshold voltages for the PMOS and NMOS transistors are performed simultaneously; and an output node connected to the voltage reference unit, for outputting the reference voltage.

2. The voltage reference circuit as claimed in claim 1, further comprising at least one resistor connected between the output node and the voltage reference unit.

3. The voltage reference circuit as claimed in claim 1, wherein the PMOS and the NMOS transistors are connected to each other in series between the output node and a ground voltage.

4. The voltage reference circuit as claimed in claim 1, wherein the PMOS and the NMOS transistors are connected to each other in parallel between the output node and a ground voltage.

5. The voltage reference circuit as claimed in claim 1, wherein the constant voltage supply unit includes:

at least one transistor:

at least one resistor coupled in series to the at least one transistor, wherein the at least one transistor operates in response to a voltage between both ends of the at least one resistor; and a node between the at least one transistor and the at least one resistor, for outputting the constant voltage.

6. The voltage reference circuit as claimed in claim 1, wherein the PMOS transistor having a source connected to a power supply voltage and a drain connected to the output node, and the at least one resistor having one end connected to the output node and the other end connected to a gale of the PMOS transistor.

7. The voltage reference circuit as claimed in claim 1, wherein the first current mirror includes:

at least a first transistor connected to the constant voltage supply unit; and at least a second transistor connected to the second current mirror;

wherein the first and the second transistors are coupled in parallel and form a current mirror.

8. The voltage reference circuit as claimed in claim 7, wherein the first transistor is a first NMOS transistor having a drain connected to the constant voltage supply unit and a source connected to a ground voltage; and the second transistor is a second NMOS transistor having a drain and a gate connected in common to a gate of the first NMOS transistor and to the second current mirror, and a source connected to the ground voltage.

9. The voltage reference circuit as claimed in claim 1, wherein the second current mirror includes:

at least a first transistor connected to the first current mirror; and at least a second transistor connected to the voltage reference unit;

wherein the first and the second transistors are coupled in parallel and form a current mirror.

10. The voltage reference circuit as claimed in claim 9, wherein the first transistor is a first PMOS transistor having a source connected to a power supply voltage, a drain connected to the first current mirror, and a gate connected to the constant voltage supply unit; and the second transistor is a second PMOS transistor having a source connected to the power supply voltage, a drain connected to the output node, and a gate connected to the constant voltage supply unit.

11. The voltage reference circuit as claimed in claim 1, wherein the PMOS and the NMOS transistors are connected to each other in series between a power supply voltage and the output node.

12. The voltage reference circuit as claimed in claim 1, wherein the PMOS and the NMOS transistors are connected to each other in parallel between a power supply voltage and the output node.

13. The voltage reference circuit as claimed in claim 5, wherein the at least one transistor is at least one NMOS transistor having a source connected to a ground voltage and a drain connected to the node; and the at least one resistor having one end connected to the node and the other end connected to a gate of the at least one NMOS transistor.

14. The voltage reference circuit as claimed in claim 7, wherein the first transistor is a first PMOS transistor having a drain connected to the constant voltage supply unit and a source connected to a power supply voltage; and the second transistor is a second PMOS transistor having a drain and a gate connected in common to a gate of the first PMOS transistor and to the second current mirror, and a source connected to the power supply voltage.

15. The voltage reference circuit as claimed in claim 9, wherein the first transistor is a first NMOS transistor having a source connected to a ground voltage, a drain connected to the first current mirror, and a gate connected to the constant voltage supply unit; and the second transistor is a second NMOS transistor having a source connected to the ground voltage, a drain connected to the output node, and a gate connected to the constant voltage supply unit.

16. The voltage reference circuit as claimed in claim 3, wherein the PMOS transistor having a source connected to the output node and a gate and a drain which are connected to each other, and the NMOS transistor having a source connected to the ground voltage and a gate and a drain which are connected in common to the drain of the PMOS transistor.

17. The voltage reference circuit as claimed in claim 4, wherein the PMOS transistor having a source connected to the output node and a gate and a drain which are connected in common to the ground voltage, and the NMOS transistor having a source connected to the ground voltage and a gate and a drain which are connected in common to the source of the PMOS transistor.

18. The voltage reference circuit as claimed an claim 11, wherein the NMOS transistor having a source connected to the output node and a grate and a drain which are connected to each other, and the PMOS transistor having a source connected to the power supply voltage and a gate and a drain which are connected in common to the drain of the NMOS transistor.

19. The voltage reference circuit as claimed in claim 12, wherein the PMOS transistor having a source connected to the power supply voltage and a gate and a drain which are connected in common to the output node, and the NMOS transistor having a source connected to the output node and a gate and a drain which are connected in common to the power supply voltage.

20. A voltage reference circuit for providing a voltage reference upon being powered by a supply voltage (VDD), said circuit comprising:

a constant voltage device to generate a first current flow upon being powered by VDD;

a first current mirror for generating a second current mirroring the first current;

a second current mirror for generating a third current mirroring the second current; and a voltage reference unit for providing the voltage reference upon flow of the third current, said voltage reference unit includes PMOS transistor operatively coupled to a NMOS transistor for providing a constant voltage as the voltage reference independent of variations in the supply voltage VDD.

21. The voltage reference circuit of claim 20, wherein ion implantation process for setting gate-to-source threshold is commonly performed to the PMOS and NMOS transistors.

* * * * *